United States Patent [19]

Mouri et al.

[11] 4,330,115

[45] May 18, 1982

[54] DISBURSING DEVICE IN MACHINE FOR COUNTING PAPER SHEETS

[75] Inventors: Shingo Mouri; Hiroshi Koyama, both of Tokyo, Japan

[73] Assignee: Laurel Bank Machine Co., Ltd., Tokyo, Japan

[21] Appl. No.: 72,557

[22] Filed: Sep. 4, 1979

[30] Foreign Application Priority Data

Sep. 5, 1978 [JP] Japan ..... 53-108918

[51] Int. Cl.[3] ..... B65H 3/52

[52] U.S. Cl. ..... 271/124; 271/270

[58] Field of Search ..... 271/124, 125, 121, 122, 271/123, 35, 34, 270, 167; 414/123, 124, 129, 130

[56] References Cited

U.S. PATENT DOCUMENTS

| | | | |
|---|---|---|---|
| 650,410 | 5/1900 | Morin | 271/121 |
| 1,262,383 | 4/1918 | Otarii et al. | 271/124 X |
| 1,637,833 | 8/1927 | Mueller | 271/124 |
| 3,869,117 | 3/1975 | Yoshimura | 271/35 X |
| 3,986,712 | 10/1976 | Hasegawa | 271/124 |
| 4,153,456 | 6/1979 | Holland-Letz | 271/125 X |

*Primary Examiner*—Bruce H. Stoner, Jr.

*Attorney, Agent, or Firm*—Fleit & Jacobson

[57] ABSTRACT

There is provided a disbursing device in a paper sheet counting machine. The disbursing device comprises a feed roller continuously rotated in one direction, a first brake plate disposed along the periphery of the feed roller to confront the feed roller, with a gap between the feed roller and the brake plate being freely adjustable, and a second brake plate disposed just behind the first brake plate and arranged so that a gap between the second brake plate and the feed roller can be adjusted independently of the adjustment of the first-mentioned gap. Two gaps can be adjusted respectively according to the thickness of paper sheets to be disbursed. The gap adjustment is performed in two stages, whereby paper sheets are reliably delivered one at a time.

4 Claims, 7 Drawing Figures

DISBURSING DEVICE IN MACHINE FOR COUNTING PAPER SHEETS

BACKGROUND OF THE INVENTION

1. Field of the Invention

The present invention relates to a disbursing device in a machine for counting paper sheets and the like, which device is adapted to disburse paper sheets one at a time from an accumulated layer thereof and count them one at a time in a reliable manner.

2. Description of the Prior Art

In the conventional delivery device of this type, the frictional force is, strictly speaking, generated at one point, the frictional force and a particular geometrical configuration of the device acting to separate and disburse paper sheets one at a time. In this delivery mechanism, if two paper sheets are introduced into a disbursement gap, they can be separated and delivered, but if three sheets are simultaneously introduced into the gap, they cannot be separated. Two sheets are then disbursed, resulting in a counting error.

SUMMARY OF THE INVENTION

The present invention seeks to eliminate the foregoing defect involved in the conventional disbursing device in a machine for counting paper sheets and the like.

More specifically, in accordance with the present invention, there is provided a disbursing device in a paper sheet counting machine, which comprises a feed roller continuously rotated in one direction, a first brake plate disposed along the periphery of the feed roller to confront the feed roller, with a gap between the feed roller and the brake plate being freely adjustable, and a second brake plate disposed just behind the first brake plate and arranged so that a gap between the second brake plate and the feed roller can be adjusted independently of the adjustment of the first-mentioned gap, wherein said two gaps can be adjusted respectively according to the thickness of paper sheets to be disbursed, the gap adjustment being performed in two stages, whereby paper sheets are reliably delivered one at a time.

BRIEF DESCRIPTION OF THE DRAWINGS

Other objects and advantages of the present invention will become apparent from the following description made with reference to the accompanying drawings, in which.

DETAILED DESCRIPTION OF THE PREFERRED EMBODIMENTS

Figure 1:
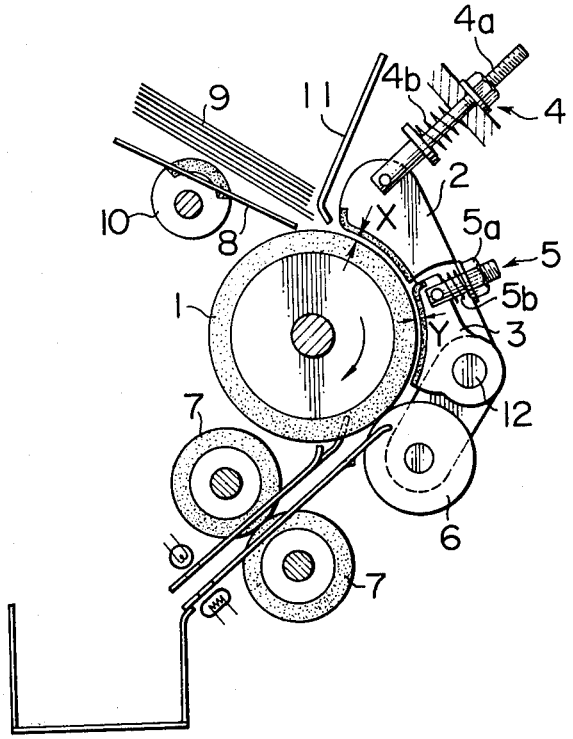
FIG. 1 is a sectional view illustrating one embodiment of the paper sheet disbursing device according to the present invention.

Other objects and advantages of the present invention will become apparent from the following description made with reference to the accompanying drawings, in which:

Referring to FIG. 1, a feed roller 1 has rubber or the like adhered to the periphery thereof and exhibits a large coefficient of friction, the feed roller 1 being driven and rotated in the direction indicated by the arrow.

A first brake plate 2 is extended along the feed roller 1 so that a gap "X" such as will allow the passage of one paper sheet is formed between the brake plate 2 and feed roller 1, with the brake plate 2 acting as a guide member. The brake plate is pivotably mounted on a pivot pin 12. A sheet of rubber or the like having a large coefficient of friction is adhered to the surface of the brake plate 2 so that the friction force thereof acts as a control force during the passage of a paper sheet.

A second brake plate 3 is disposed just behind the first brake plate 2 and is arranged in the same manner as the first brake plate 2 except that the gap "Y" between the feed roller 1 and the second brake plate 3 is slightly narrower than the gap between the feed roller 1 and the first brake plate 2. The brake plate 3 is also pivotably mounted on the pivot pin 12. A gap distance adjusting member 4 comprises an adjustment screw 4*a* and a spring 4*b*, and is arranged so that the gaps that separate the feed roller from the brake plates can be adjusted according to paper thickness.

A gap distance adjusting member 5 comprises an adjustment screw 5*a* and a spring 5*b*, and is arranged so that the gap "Y" between the second brake plate and the feed roller is made slightly narrower than the gap "X" between the first brake plate and the feed roller. A press roller 6 is constantly urged against the feed roller by means of a spring to press a passing paper against the feed roller 1.

Accelerator rollers 7 are disposed such that a gap suitable for counting can be formed between every two adjacent paper sheets which are continuously disbursed. The paper sheets which are disbursed and counted can therefore easily be accumulated in an accumulation box.

Figure 2A:
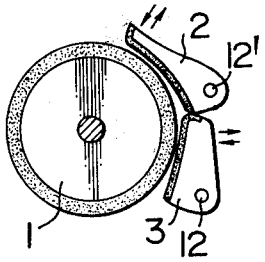
FIGS. 2*a* through 2*c* are views illustrating the relation between the feed roller and brake means in other embodiments of the paper sheet disbursing device according to the present invention.
Figure 2B:
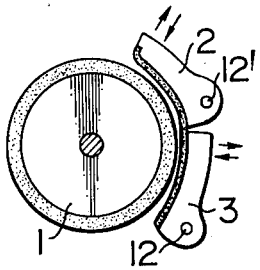
Figure 2C:
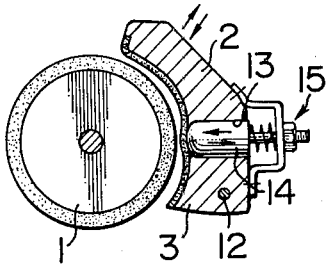

FIGS. 2*a* through 2*c* show other embodiments of the first brake plate 2 and the second brake plate 3. In the embodiment of FIG. 2*a*, the brake plates 2 and 3 are pivotably mounted on separate pivot pins 12' and 12. Each brake plate is provided with a sheet of rubber. Each brake plate is provided with a gap distance adjusting member, not shown, so that the gap between the brake plate and the feed roller is adjusted. In the embodiment of FIG. 2*b*, the brake plates 2 and 3 are constructed in a similar manner to those of FIG. 2*a* except that a single common sheet of rubber is provided on two brake plates. In the embodiment of FIG. 2*c*, the brake plate 2 is integral with the brake plate 3. The brake plate 2, 3 has a sheet of rubber provided on its periphery. The brake plate 2, 3 are formed with a through-aperture 13 in which an adjusting member 14 for adjusting is positioned. The adjusting member 14 functions to vary the gap distance between the feed roller and the sheet of rubber by deformation of the sheet of rubber. The deformation is made by a gap distance adjusting member 15 similar to the adjusting member 5.

The operation of the disbursing device having the above-mentioned structure will now be described.

One to three paper sheets 9 stacked on a paper feed stand 8 are advanced through a gap between the paper feed stand 8 and a regulating plate 11 by a kick-out roller 10, and are then introduced between the feed roller 1 and the first brake plate 2 and then passed between the feed roller 1 and the second brake plate 3. During this interval, the paper sheets can be reliably separated owing to the difference in frictional force between the feed roller 1 and each of the brake plates 2 and 3, and they are disbursed one at a time.

Figure 3:
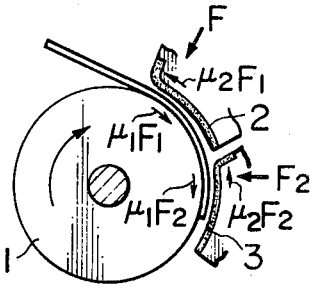
FIG. 3 is a view illustrating the state where one paper sheet is introduced between the roller and brake plate.

When one paper sheet is introduced between the feed roller and the brake plates as shown in FIG. 3, let the frictional coefficient between the feed roller and paper be represented by $\mu 1$, the frictional coefficient between the brake plates and paper by $\mu 2$, the normal load imposed on the paper introduced between the feed roller and the first brake plate by F1, and the normal load imposed on the paper introduced between the feed roller and the second brake plate by F2. Then, a feed-out force expressed by $\mu 1$ (F1+F2) and a braking force expressed by $\mu 2$ (F1+F2) acts on the paper sheet, as a frictional force. Accordingly, if an arrangement is adopted such that an inequality $\mu 1 > \mu 2$ is established, the feed-out force will exceed the braking force, and the paper sheet will be disbursed by the feed roller.

When two paper sheets are introduced between the feed roller and the first brake plate, if an arrangement is adopted such that an inequality $\mu 1 > \mu 2 > \mu 3$ is established in which $\mu 1$ and $\mu 2$ are as defined above and $\mu 3$ represents the coefficient of friction between the paper sheets, the feed-out force $\mu$1F1 and the braking force $\mu$3F1 act on the paper sheet 9*a* on the feed roller side and the feed-out force $\mu$3F1 and the braking force $\mu$2F1 act on the paper sheet 9*b* on the brake plate side.

In this case since inequalities $\mu$1F1 > $\mu$3F1 and $\mu$3F1 < $\mu$2F1 are established, the paper sheet 9*a* on the feed roller side is disbursed by the feed roller, but the paper sheet 9*b* on the brake plate side is restricted by the brake plate. However, after disbursement of the first paper sheet 9*a*, the same state as shown in FIG. 3 is attained and the second paper sheet 9*b* is then disbursed.

Figure 5:
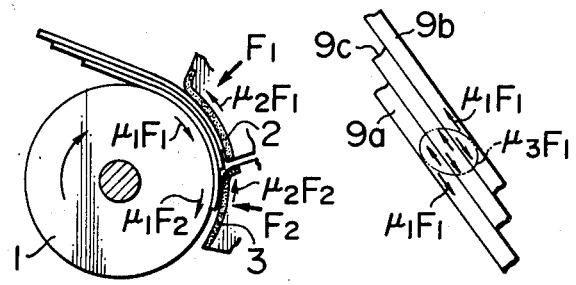
FIG. 5 is a view illustrating the state where three paper sheets are introduced between the roller and brake plate.

When three paper sheets are introduced between the feed roller and the first brake plate as shown in FIG. 5, for the same reasons as described above, the first paper sheet 9*a* is disbursed and the third paper sheet 9*b* is restricted. However, the difference between the feed-out force $\mu$3F1 and the braking force $\mu$3F1 is actually unstable, and it has been found that the second paper sheet 9*c* is advanced together with the first paper sheet 9*a*, or restricted together with the second paper sheet 9*b*, or advanced at a speed corresponding to about ½ of the disbursement speed while slipping.

Figure 4:
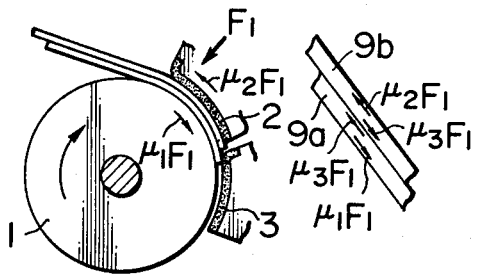
FIG. 4 is a view illustrating the state where two paper sheets are introduced between the roller and brake plate.

In the present invention, since the second brake plate 3 is disposed just behind the first brake plate 2, according to the same principle as in case of FIG. 4, the first paper sheet 9*a* is disbursed by the feed roller 1 and the second paper sheet 9*c* is restricted by the second brake plate 3. After disbursement of the first paper sheet 9*a*, the second paper sheet 9*c* is delivered, and then the third paper sheet 9*b* is disbursed in sequence. The gap between every two adjacent paper sheets continuously disbursed in this manner is broadened by the accelerator roller 7 and the paper sheets are fed to the counting zone.

As will be apparent from the foregoing illustration, when one paper sheet is introduced between the feed roller and the brake plate, it is smoothly disbursed because the frictional force between the paper sheet and the feed roller is larger than the frictional force between the paper sheet and the brake plate. When two paper sheets are introduced, since the frictional force between the paper sheet and the feed roller and the frictional force between the paper sheet and the brake plate are larger than the frictional force between the paper sheets, one paper sheet is disbursed and the other paper sheet restricted once and then disbursed after delivery of the first paper sheet.

When three paper sheets are introduced between the feed roller and the first brake plate, at least one paper sheet is restricted and restrained against the first brake plate by the frictional force of the first brake plate, and one or two paper sheets are introduced between the second brake plate and the feed roller and are separated and sequentially disbursed from one close to the feed roller by the difference in the frictional forces generated.

It is possible in practice to limit the number of paper sheets fed at one time between the feed roller and the brake plate to three or less by the configuration of the regulating plate 11. Therefore, if brake plates of two stages are disposed as described above, simultaneous disbursement of two paper sheets, which is often observed in the conventional device, can be completely prevented. Furthermore, by virtue of the feature that the gap between the second stage brake plate and the feed roller is slightly smaller than the gap between the first stage brake plate and the feed roller, two paper sheets can be reliably separated from each other and successfully disbursed one at a time even if the two paper sheets are new and adhere to each other very closely.

As will be apparent from the foregoing illustration according to the present invention, there is provided a disbursing device in a paper sheet counting machine in which the disbursing operation can be accomplished at a high accuracy and reliability not attainable in the conventional device, this being made possible by performing the separation and disbursement of paper sheets in the foregoing two-staged manner.

What is claimed is:

1. A disbursement device in a paper sheet counting machine, which comprises:

a feed roller continuously rotated in one direction;

a first brake plate having an arcuate shape conforming to the periphery of the feed roller disposed along the periphery of the feed roller to confront said feed roller, with a first gap between the feed roller and the first brake plate;

first means for adjusting the first gap;

a second brake plate having an arcuate shape conforming to the periphery of the feed roller disposed just behind said first brake plate and arranged with a second gap between the second brake plate and feed roller;

a single sheet of rubber attached to both of said brake plates; and second means independent from said first means for adjusting the second gap wherein said two gaps can be adjusted respectively according to the thickness of paper sheets to be disbursed, the gap adjustment being performed in two stages, the positioning of the first and second brake plates with respect to said feed roller and the adjustment of said first and said second gaps being such that when a plurality of sheets are fed between said first brake plate and said feed roller the sheet closest to said feed roller is fed into said second gap first, whereby paper sheets are reliably disbursed one at a time.

2. A device as set forth in claim 1 wherein said first gap between said feed roller and said first brake plate is equal to or greater than said second gap between said feed roller and said second brake plate.

3. A device as set forth in claim 1 wherein each of said brake plates is pivotably mounted on a separate pivot pin.

4. A device as set forth in claim 1 wherein the frictional coefficient of the feed roller against the paper is selected to be greater than the frictional coefficient of the single sheet of rubber attached to said first and second brake plates against the paper and the frictional coefficient of the single sheet of rubber attached to said first and second brake plates against the paper is selected to be greater than the frictional coefficient between the papers.

* * * * *